US007040361B2

(12) United States Patent
Soussan et al.

(10) Patent No.: US 7,040,361 B2
(45) Date of Patent: May 9, 2006

(54) DISPENSING NOZZLE ENGAGEMENT DEVICE

(76) Inventors: Benjamin J. Soussan, 968 Ocean Blvd., Hampton, NH (US) 03842; Benjamin E. Caron, 301 Concord St., Haverhill, MA (US) 01830

( * ) Notice: Subject to any disclaimer, the term of this patent is extended or adjusted under 35 U.S.C. 154(b) by 277 days.

(21) Appl. No.: 10/457,808

(22) Filed: Jun. 9, 2003

(65) Prior Publication Data

US 2004/0173631 A1 Sep. 9, 2004

Related U.S. Application Data

(60) Provisional application No. 60/387,020, filed on Jun. 7, 2002.

(51) Int. Cl.
*B65B 3/00* (2006.01)

(52) U.S. Cl. ..... 141/392; 251/90; 251/111; 222/151.01; 222/151.03

(58) Field of Classification Search ..... 222/151.01, 222/151.03; 141/392; 251/90, 111; D8/349, D8/354; 74/526
See application file for complete search history.

(56) References Cited

U.S. PATENT DOCUMENTS 4,175,595 A * 11/1979 Noe ..... 141/392
4,201,253 A * 5/1980 Maloney ..... 141/392
4,210,181 A * 7/1980 Clevenger ..... 141/392
4,245,682 A * 1/1981 Agnew, Sr. ..... 141/392
4,337,917 A * 7/1982 Tesack et al. ..... 141/392
4,722,375 A * 2/1988 Fox ..... 141/392
5,487,418 A * 1/1996 Reyes ..... 141/392
5,595,367 A * 1/1997 Sternes et al. ..... 251/90
6,095,173 A * 8/2000 Perry ..... 141/392
6,273,157 B1 * 8/2001 Molnar ..... 141/392
6,279,621 B1 * 8/2001 Gelsomino ..... 141/392
6,418,988 B1 * 7/2002 Palumbo et al. ..... 141/392
2002/0185622 A1 * 12/2002 Bruns ..... 141/392

* cited by examiner

*Primary Examiner*—Michael Mar
*Assistant Examiner*—Sonia N. Khaira
(74) *Attorney, Agent, or Firm*—Bourque & Assoc.

(57) ABSTRACT

A dispensing nozzle activation lever lock for use with a dispensing nozzle such as a fuel dispensing nozzle having a handle portion, a trigger guard, and a pump activation lever allows an operator to dispense fuel without having to continuously hold the pump activation lever. The fuel pump activation lever lock includes a first and second engagement arm disposed opposite ends of each other. The first engagement end engages the trigger guard, while the second engagement arm engages the pump activation lever such that the fuel pump activation lever lock holds the pump activation lever in a position wherein the fuel pump nozzle continuously dispenses fuel without the operator holding the pump activation lever. The fuel pump activation lever lock also preferably includes a slot sized and shaped to engage a fuel cap such that the fuel pump activation lever lock may be stored within a fuel chamber on a vehicle.

20 Claims, 5 Drawing Sheets

DISPENSING NOZZLE ENGAGEMENT DEVICE

This application claims benefit of priority of Provisional Patent Application Ser. No. 60/387,020 filed Jun. 7, 2002.

FIELD OF THE INVENTION

Background

With the advent of self-serve gasoline, vehicle owners are increasingly likely to pump their own fuel at the gas station. Most gas station pumps are materially identical in that they comprise a pump, a hose coupled to the pump and a nozzle on the end of the hose. Most, if not all, such nozzles have a handle with a trigger guard member and a pump activation lever. The user operates the pump by squeezing the pump activation lever against the nozzle handle.

Generally, the pump continues to pump fuel only so long as the user holds the pump activation lever in the engaged position. Some nozzles contain a pump activation lever lock that holds the pump activation lever in the engaged position. Unfortunately, many stations have removed the pump activation lever lock, thereby forcing customers to continuously, manually hold the pump activation lever in the engaged position. The lack of a nozzle lever lock is particularly unpleasant is cold or rainy weather. Further the lack of a nozzle lock prevents the user from simultaneously washing vehicle windows, checking the oil level, remaining in the vehicle or perhaps going into a store to purchase some supplies.

Accordingly, what is needed is a device that a vehicle user could keep on with their vehicle or on their person that can be used safely and effectively as a pump activation lever lock.

SUMMARY OF THE INVENTION

The present invention is directed to a nozzle activation lever lock for holding a nozzle lever, such as a fuel pump activation lever, into an engaged position, and includes an engagement body (preferably constructed from PVC) and a first and second engagement arm.

The first engagement arm is disposed on a first end of the engagement body and is sized and shaped to extend on either side of the trigger guard. In the preferred embodiment, the first engagement arm further comprises an engagement lip that engages a portion of the trigger guard. Additionally, the first engagement arm also includes a substantially flat lower surface.

The second engagement arm is disposed on a second end of the engagement body such that the first and the second engagement arm are spaced far enough from another to hold the activation lever in an engaged position. The second engagement arm is also sized and shaped to extend across the width of a bottom of the activation lever. In the preferred embodiment, the second engagement arm further includes a substantially concaved outer surface. According to another embodiment, the second engagement arm further comprises an engagement lip that engages a portion of the trigger guard and/or a relief notch.

The fuel pump activation lever preferably further includes a slot disposed within the engagement body. The slot is sized and shaped to releaseably engage a fuel cap. Alternatively, the fuel pump activation lever lock may include a means to secure the fuel pump activation lever lock to a fuel cap, such as a hook and loop fastener or a magnetic fastener.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
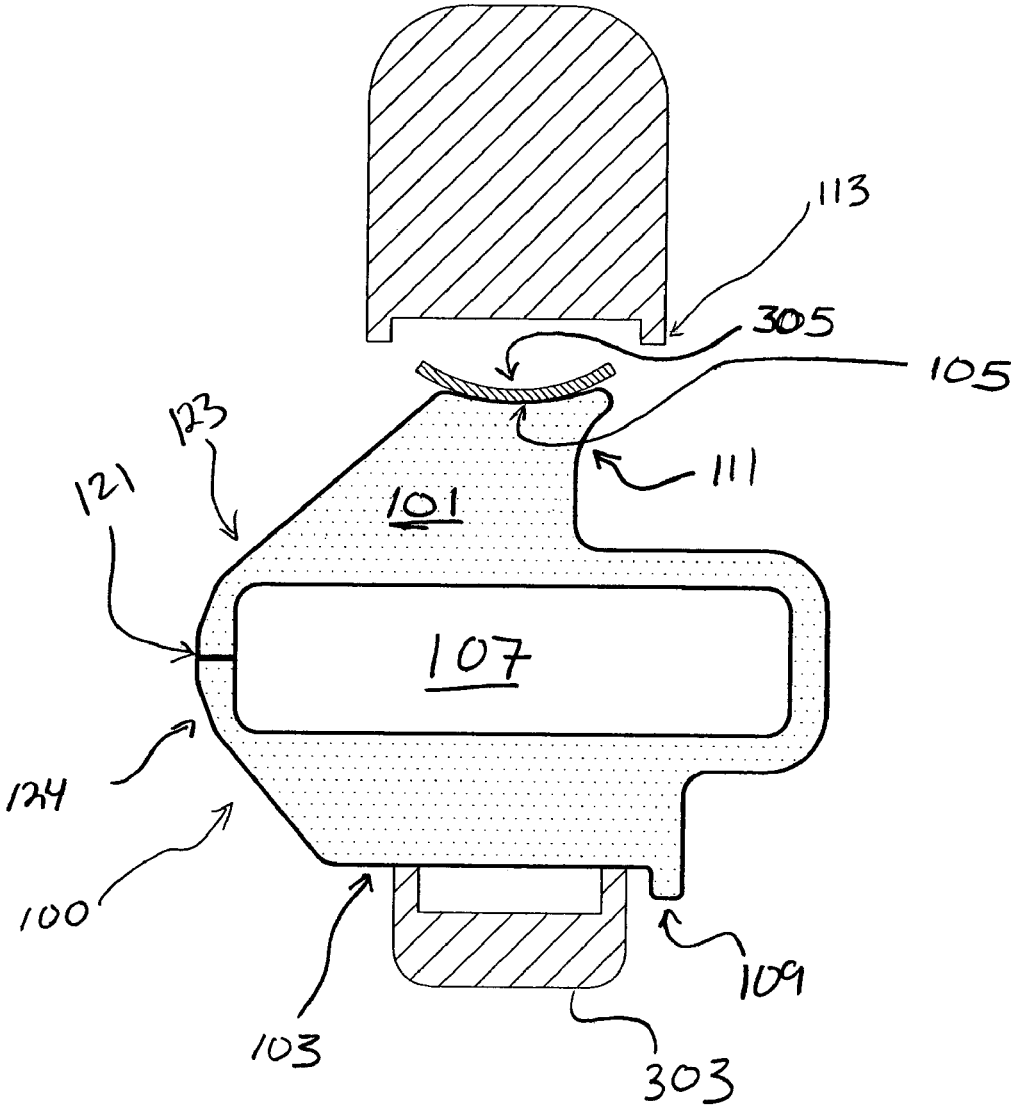
FIG. 1 is a cross-sectional side view of a pump activation lever lock engaged with a pump nozzle in accordance with a preferred embodiment of the present invention.
Figure 2:
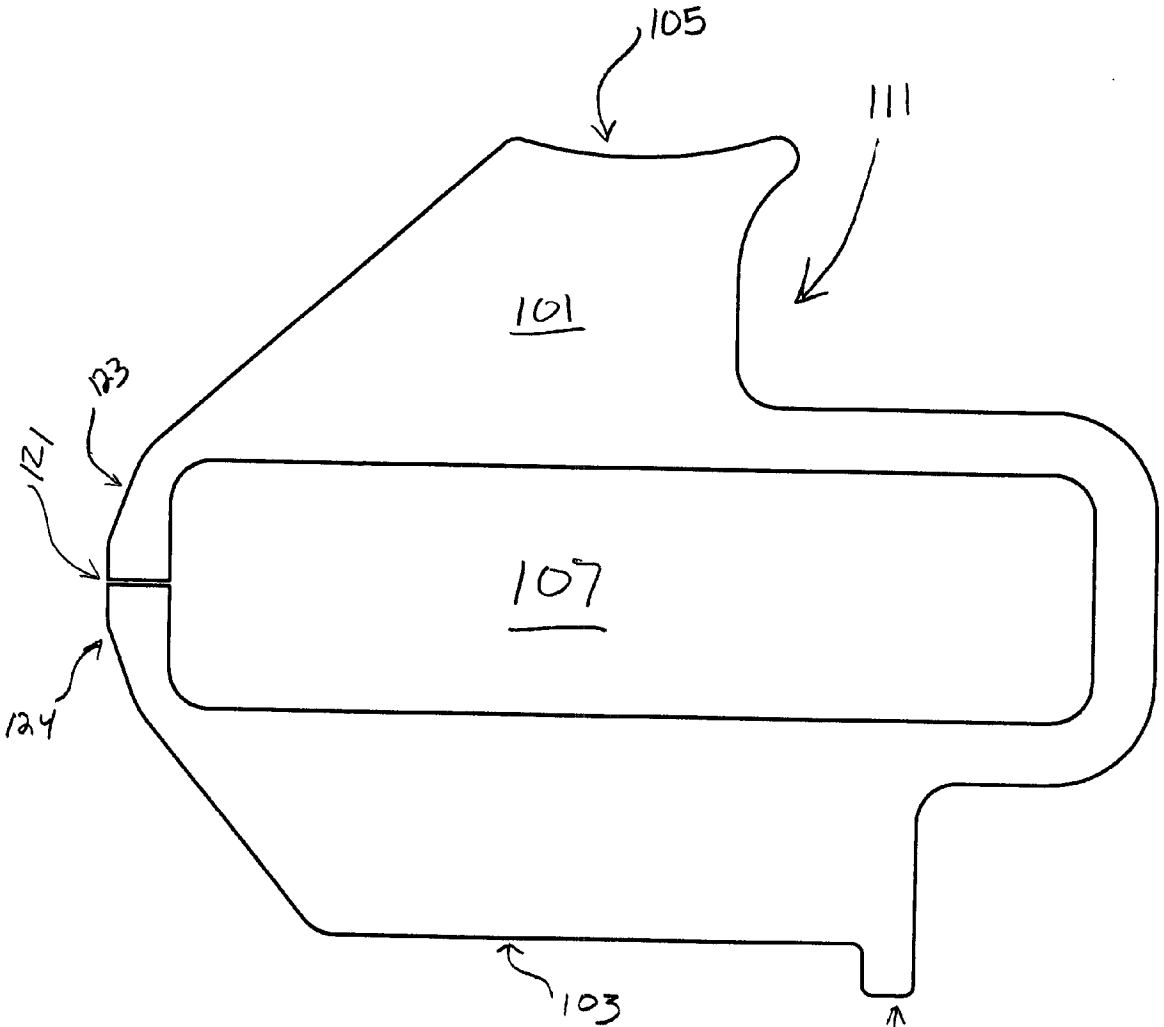
FIG. 2 is a side view of a pump activation lever lock in accordance with a preferred embodiment of the present invention.
Figure 3A:
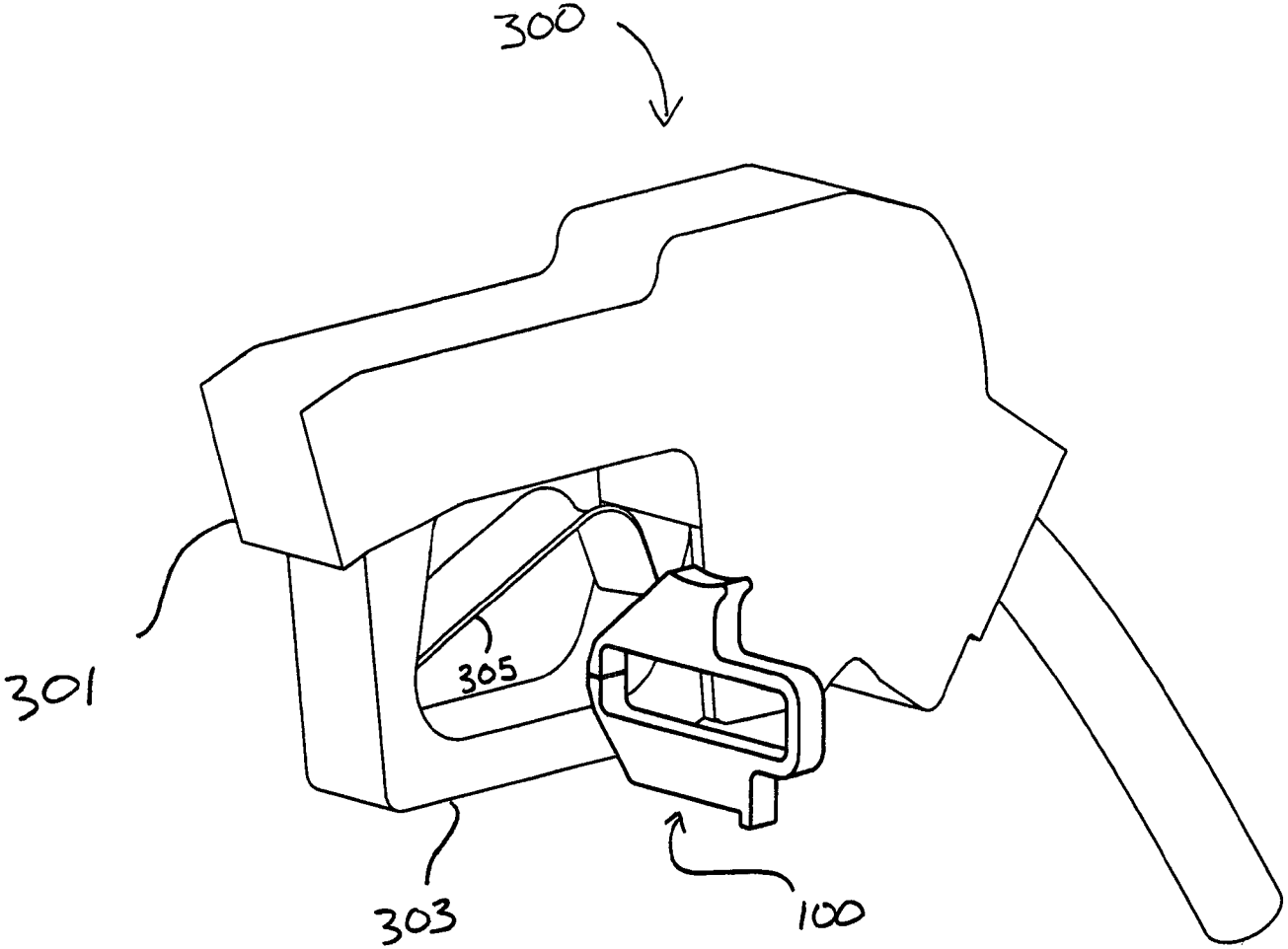
FIGS. 3A and 3B are perspective views of a pump activation lever lock in use in accordance with a preferred embodiment of the present invention.
Figure 3B:
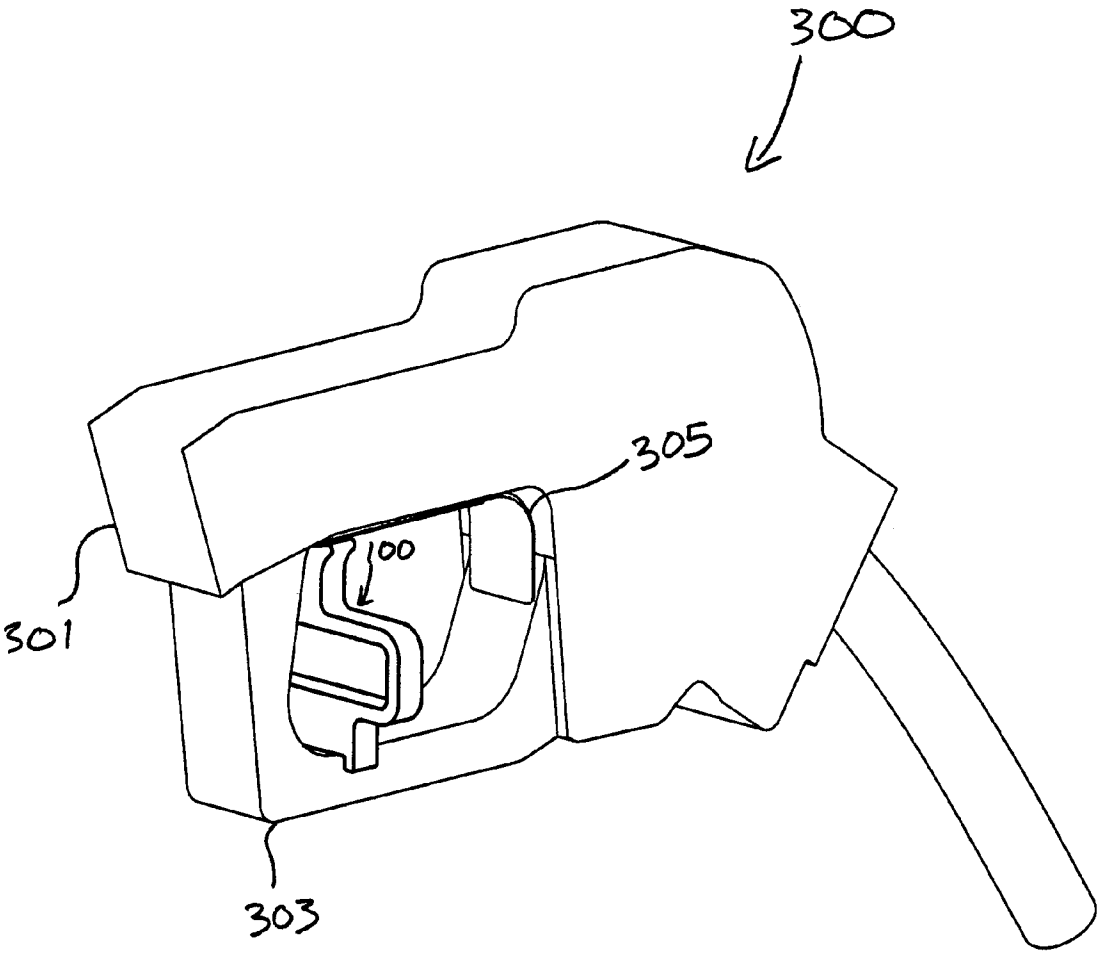
Figures 4A, 4B:
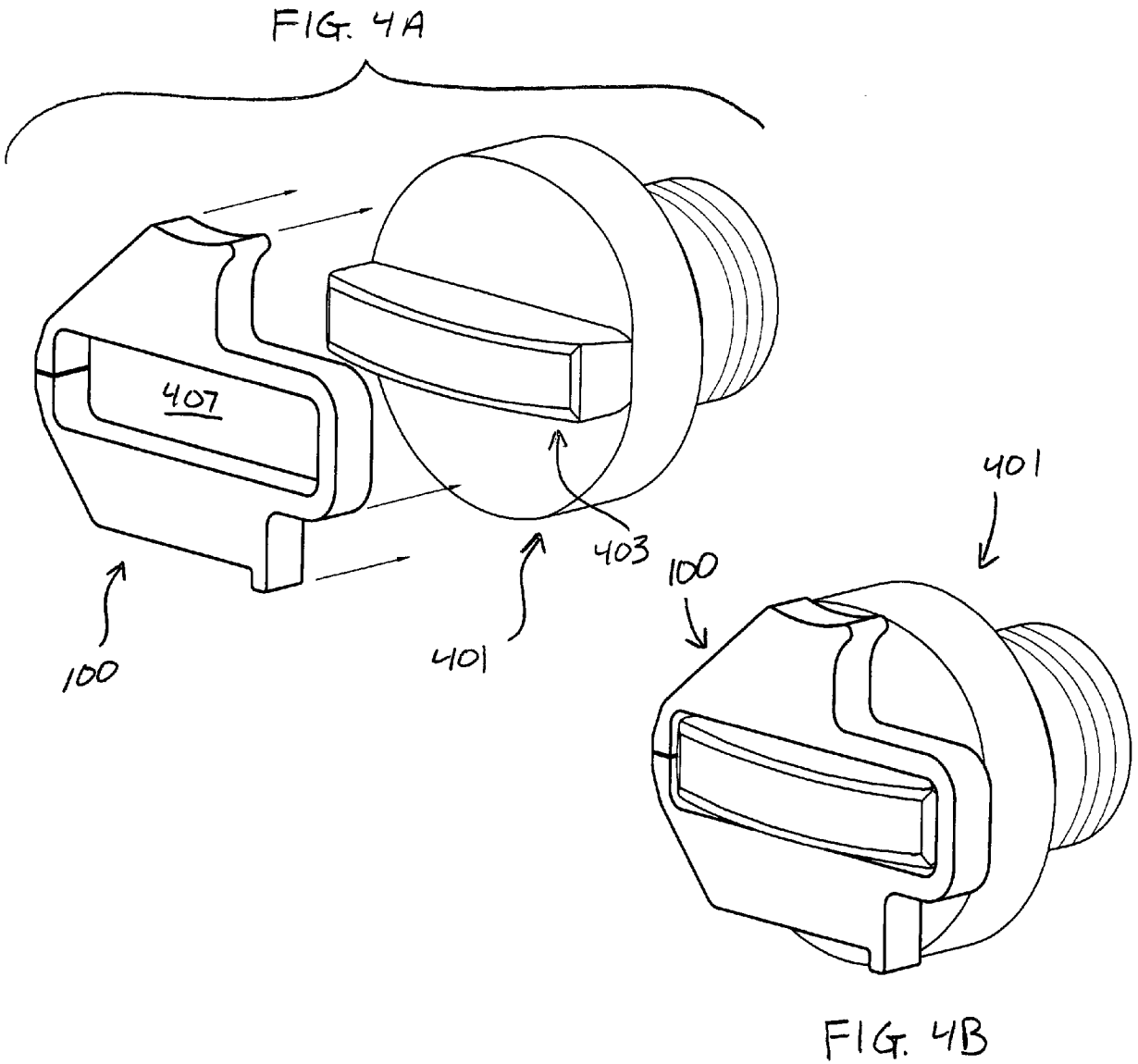
FIGS. 4A and 4B are perspective views of a pump activation lever lock being placed in a storage position in accordance with a preferred embodiment of the present invention.

The present invention is directed to a dispensing nozzle activation lever lock 100 (hereinafter "lever lock") for use in connection with any dispensing nozzle including, without limitation, a fuel pump nozzle 300 of the type shown in FIGS. 3A and 3B. Fuel pump nozzles 300 of the type shown in FIGS. 3A and 3B comprise a handle portion 301, a trigger guard 303, and a pump activation lever 305 (hereinafter "activation lever"). The lever locks in accordance with the present invention are further preferably adapted to be stored inside a fuel cap chamber of a vehicle, preferably in engagement with a standard fuel cap 401 as shown in FIGS. 4A and 4B A lever lock 100 in accordance with the present invention comprises an engagement body 101 comprising, a first engagement arm 103, and a second engagement arm 105. The engagement body 101 preferably further comprises a docking slot 107 formed in the engagement body and adapted to fit over a variety of standard fuel caps.

The engagement body 101 is made from any material of sufficient structural integrity to hold a pump activation lever in an engaged position. Such material is preferably non-corrosive, light weight, inexpensive, and easy to mold or otherwise manufacture into the desired form. Generally, PVC or other plastics are the preferred materials.

The engagement body comprises a first engagement arm 103 adapted to engage the trigger guard 303 of a dispensing nozzle. Accordingly, the engagement arm 103 is preferably of sufficient width to extend across the entire width of a trigger guard 303. In a preferred embodiment, the first engagement arm 103 is sufficiently wide to extend about 3.175 mm. (⅛ inch) on either side of the trigger guard 303. For use on nozzles commonly in use on the date of this application, the first engagement arm 103 is preferably about 36.45 mm. (1.435) to about 40.67 mm. (1.601 inches) wide. In addition, the first engagement arm 103 preferably includes an engagement lip 109 to assist in maintaining the lever lock in the engaged position. With the exception of the lip 109, the lower surface of the first engagement arm 103 is preferably flat.

The engagement body 101 further comprises a second engagement arm 105 adapted to engage a nozzle activation lever 305. The second engagement arm 105 is preferably of sufficient width to extend across the width of the bottom of a nozzle activation lever 305. The second engagement arm 105 is also preferably slightly concave to assist in engaging activation levers 305, which are typically slightly convex on their lower surface. The second engagement arm 105 preferably further comprises a relief notch 111 to provide clearance for a pump handle lip 113, which is found on some pump handles.

The engagement body further preferably comprises a docking or storage slot 107 adapted to fit over the ridge 403 of a gas cap 401. The docking slot 107 is sized so as to be of sufficient size to fit over the ridges 403 of most, if not all, standard gas caps 401. Preferably, the docking slot 107 is about 17.27 mm. (0.68 inches) to about 25.4 mm. (1 inch) wide. More preferably, the docking slot is about 19.05 mm. (0.75 inches) wide. Preferably, the docking slot is at least about 66.55 mm. (2.62 inches) long and, more preferably is about 71.12 mm. (2.8 inches) long.

The dimensions of the engagement body 101 as a whole may vary significantly within the scope of the invention. However, the dimensions of the preferred engagement body 101 are such that the engagement surfaces of the first and second engagement arms 103, 105 are spaced far enough from one another to hold the activation lever 305 in the engaged, preferably fully engaged, position. Preferably, engagement surfaces of the first and second engagement arms 103, 105 are spaced at least about 50.8 mm. (2 inches) apart, and most preferably about 50.8 mm. (2.358 inches) apart. In addition, the dimensions of the preferred engagement body are preferably such that the device securely holds the activation lever in the engage position and yet is small enough such that the entire device can fit inside the gas cap chamber of most vehicles. Accordingly, the engagement body is preferably at least about 3.175 mm. (⅛ inch) thick. Preferably the engagement body is about 4.762 (3/16) to about 12.7 mm. (½ inch) thick. Most preferably, the engagement body is about 9.525 mm. (0.375 inches) thick.

The engagement body preferably further comprises means for being secured to a gas cap or other portion of the vehicle. For example, the engagement body may be secured to the gas cap with hook and loop fasteners, a magnet, or other suitable fasteners. Alternatively, the engagement body may be adapted to serve as or be attached to a key chain or the like.

In the preferred embodiment, the engagement body 101 may include a slit 121 that preferably forms a channel in the engagement body 101 which leads to the docking slot 107. The slit 121 allows the lever lock 100 to be secured around the leader or retainer (not shown) that is commonly used to secure a gas cap to the vehicle. According to one embodiment, the slit 121 allows the two portions 123, 124 of the engagement body 101 to be spread apart and separated slightly to fit around the gas cap leader. Alternatively, the slit may form a channel having a cross section approximately equal to that of the gas cap leader. For exemplary purposes only, the slit 121 is about 4.775 mm. (0.188 inches) wide and runs from the outside surface of the engagement body 101 to the docking slot 107.

Also note that use of the present invention must comply with all applicable local, state, and federal regulations. Many modifications and substitutions may be made by one of ordinary skill in the art and are considered to be within the scope of the present invention.

What is claimed is:

1. A dispensing nozzle activation lever lock for use with a dispensing nozzle having a handle portion, a trigger guard, and a pump activation lever, said dispensing nozzle activation lever lock comprising:

an engagement body;

a first engagement arm disposed on a first end of said engagement body, said first engagement arm sized and shaped to extend on either side of said trigger guard;

a second engagement arm disposed on a second end of said engagement body opposite said first engagement arm along a longitudinal axis of said engagement body, such that said first and said second engagement arms are spaced far enough from another to hold said activation lever in an engaged position when said first and said second engagement arms are disposed said handle portion, said pump activation lever, and said trigger guard, said second engagement arm sized and shaped to extend across the width of a bottom of said activation lever; and a slot disposed within said engagement body between said first and said second engagement arms, said slot having a length, a width and an inner perimeter sized and shaped to substantially conform to the shape of and surround an entire perimeter of an external ridge of a fuel cap when received within said slot wherein said length of said slot is disposed along a transverse axis of said engagement body and is longer than said width.

2. The dispensing nozzle activation lever lock as claimed in claim 1 wherein said slot is approximately 0.68 inches to approximately 1.0 inch wide.

3. The dispensing nozzle activation lever lock as claimed in claim 1 wherein said slot is at least approximately 2.62 inches long.

4. The dispensing nozzle activation lever lock as claimed in claim 1 wherein said engagement body is constructed from PVC.

5. The dispensing nozzle activation lever lock as claimed in claim 1 wherein said first engagement arm further comprises an engagement lip extending outwardly generally along said longitudinal axis of said engagement body that engages a portion of said trigger guard, said engagement lip being disposed about only one edge of said first engagement arm.

6. The dispensing nozzle activation lever lock as claimed in claim 1 wherein said first engagement arm includes a substantially flat lower surface.

7. The dispensing nozzle activation lever lock as claimed in claim 1 wherein said first engagement arm is approximately 1.435 inches long.

8. The dispensing nozzle activation lever lock as claimed in claim 1 wherein said second engagement arm further includes a substantially concaved outer surface.

9. The dispensing nozzle activation lever lock as claimed in claim 1 wherein said second engagement arm further comprises an engagement lip that engages a portion of said trigger guard.

10. The dispensing nozzle activation lever lock as claimed in claim 1 wherein said second engagement arm further comprises a relief notch.

11. The dispensing nozzle activation lever lock as claimed in claim 1 wherein said first and said second engagement arms are at least approximately 2 inches apart from each other.

12. The dispensing nozzle activation lever lock as claimed in claim 1 wherein said engagement body is approximately 3/16 inch to approximately ½ inch thick.

13. The dispensing nozzle activation lever lock as claimed in claim 1 wherein said fuel pump activation lever lock is adapted to be attached to a key chain.

14. The dispensing nozzle activation lever lock as claimed in claim 1 wherein said engagement body further includes a slit disposed along said transverse axis of said engagement body.

15. The dispensing nozzle activation lever lock as claimed in claim 14 wherein said slit further includes a channel.

16. A dispensing nozzle activation lever lock for use with a fuel pump nozzle having a handle portion, a trigger guard, and a pump activation lever, said fuel pump activation lever lock comprising:

an engagement body comprising:

a first engagement arm disposed on a first end of said engagement body, said first engagement arm sized and shaped to extend on either side of said trigger guard;

a second engagement arm disposed on an opposite end of said engagement body along a longitudinal axis of said first engagement body such that said first and said second engagement arm are spaced far enough from another to hold said activation lever in an engaged position when said first and said second engagement arms are disposed said handle portion, said pump activation lever, and said trigger guard, said second engagement arm sized and shaped to extend across the width of a bottom of said activation lever; and a slot defining a cavity having:

a first pair of parallel and longitudinally spaced surfaces having a first length disposed along an axis substantially transverse to said longitudinal axis of said engagement body and having a first length along said transverse axis;

a second pair of parallel and longitudinally spaced surfaces having a second length along said longitudinal axis that is smaller than said first length, wherein said first and second pairs of surfaces define an inner perimeter sized and shaped to substantially conform to the shape of and surround a perimeter of an external ridge of a fuel cap when received within said slot.

17. The dispensing nozzle activation lever lock as claimed in claim 16 further comprising a notch disposed proximate said second engagement arm.

18. The dispensing nozzle activation lever lock as claimed in claim 16 further comprising an engagement lip that engages a portion of said trigger guard.

19. The dispensing nozzle activation lever lock as claimed in claim 16 wherein said engagement body further includes a slit disposed in one of said second pair of surfaces.

20. The dispensing nozzle activation lever lock as claimed in claim 19 wherein said slit further includes a channel.

* * * * *